US012161240B2

(12) United States Patent
Malott et al.

(10) Patent No.: US 12,161,240 B2
(45) Date of Patent: Dec. 10, 2024

(54) APPARATUS FOR SUSPENDING OBJECTS ON A WALL

(71) Applicant: The Hillman Group, Inc., Cincinnati, OH (US)

(72) Inventors: Dale G. Malott, Chandler, AZ (US); Gaith Alawwad, Mesa, AZ (US)

(73) Assignee: THE HILLMAN GROUP, INC., Forest Park, OH (US)

( * ) Notice: Subject to any disclaimer, the term of this patent is extended or adjusted under 35 U.S.C. 154(b) by 9 days.

(21) Appl. No.: 17/553,042

(22) Filed: Dec. 16, 2021

(65) Prior Publication Data

US 2022/0211194 A1 Jul. 7, 2022

Related U.S. Application Data

(60) Provisional application No. 63/134,619, filed on Jan. 7, 2021.

(51) Int. Cl.
*A47G 1/16* (2006.01)

(52) U.S. Cl.
CPC ..... *A47G 1/1606* (2013.01)

(58) Field of Classification Search
CPC ..... A47G 1/1606
USPC ..... 248/475.1
See application file for complete search history.

(56) References Cited

U.S. PATENT DOCUMENTS 2,299,443 A * 10/1942 Walmsley ..... A47G 1/1606 248/301
3,155,358 A * 11/1964 Carlson ..... A47G 1/1606 248/688
3,861,639 A * 1/1975 Morrill ..... A47G 1/1606 248/489
5,303,895 A * 4/1994 Hart ..... A47G 1/20 248/475.1
5,961,090 A * 10/1999 Parkin ..... A47G 1/1606 248/475.1
6,286,802 B1 * 9/2001 Munson ..... A47G 1/1606 248/475.1
D506,125 S * 6/2005 Munson ..... D8/373
D506,919 S * 7/2005 Munson ..... D8/373
7,055,289 B2 * 6/2006 Guth ..... E04B 1/2612 52/327
D531,488 S * 11/2006 Munson ..... D8/373
D542,631 S * 5/2007 Munson ..... D8/373
D551,542 S 9/2007 Gallien
7,293,754 B2 * 11/2007 Gallien ..... A47G 1/1606 248/221.11
7,708,252 B2 * 5/2010 Vander Berg ..... A47G 1/1606 248/475.1

(Continued)

*Primary Examiner* — Muhammad Ijaz

(74) *Attorney, Agent, or Firm* — THOMPSON HINE LLP

(57) ABSTRACT

An apparatus for supporting an object on a wall includes a wall member including a rear side defining a wall mount plane to be held against a wall surface and a recess defined at least in part by a front wall portion. A frame member includes a frame mount section and an arm extending downward from the frame mount section for positioning down into the recess of the wall member for support. The front wall portion and the arm are configured such that an interaction of the arm and a rear surface of the front wall portion during a downward movement of the arm into the recess, while the frame mount section is spaced away from the wall surface, will cause at least one of the front wall portion or the arm to move.

17 Claims, 12 Drawing Sheets

(56) References Cited

U.S. PATENT DOCUMENTS

| | | | | |
|---|---|---|---|---|
| 7,802,769 | B1 | 9/2010 | Lindsey | |
| 8,857,780 | B1 | 10/2014 | Goss | |
| 9,185,979 | B1 | 11/2015 | Jenks | |
| 9,521,915 | B1 * | 12/2016 | Tanger | A47G 1/1606 |
| 2002/0125389 | A1 * | 9/2002 | Chu | A47B 96/027 248/235 |
| 2002/0179805 | A1 * | 12/2002 | DeLine | A47G 1/1606 248/542 |
| 2003/0003822 | A1 | 2/2003 | Holmes | |
| 2003/0038222 | A1 * | 2/2003 | Holmes | A47G 1/1606 248/490 |
| 2005/0072894 | A1 * | 4/2005 | Grant | A47B 95/008 248/475.1 |
| 2006/0186304 | A1 * | 8/2006 | McGee | A47G 1/1606 248/476 |
| 2007/0023595 | A1 * | 2/2007 | Harmsen | A47G 1/1606 248/227.2 |
| 2009/0050775 | A1 * | 2/2009 | Constantinou | A47G 1/1606 248/489 |
| 2011/0058322 | A1 * | 3/2011 | Lee | F16M 11/10 361/679.01 |
| 2012/0153108 | A1 * | 6/2012 | Schneider | A47G 1/1606 248/220.21 |
| 2016/0245457 | A1 * | 8/2016 | Skull | H05K 5/0017 |
| 2022/0211194 | A1 * | 7/2022 | Malott | A47G 1/1606 |

* cited by examiner

APPARATUS FOR SUSPENDING OBJECTS ON A WALL

TECHNICAL FIELD

The application relates generally to devices operable to hang an object on a wall, more specifically but not by way of limitation an apparatus configured to suspend an open back canvas or art board either with or without a frame, wherein the apparatus includes a wall member and a frame member.

BACKGROUND

Homeowners regularly decorate the interior of the rooms of their homes. Paintings and pictures are typically framed works of art with the former many times being applied to a canvas or similar item having an open back design. Various types of hanging devices are known, including French cleats.

U.S. Pat. No. 9,521,915 describes on variation of a French cleat in the form of an apparatus operable to provide hanging of an object (e.g., an open back canvas) on a vertical wall. The apparatus includes a wall member and a frame member. The wall member includes a lower portion and an upper portion. The upper portion is configured to angularly extend away from a wall subsequent to mounting. The upper portion of the wall member includes a first leg member and a second leg member with an intermediate channel. The frame member includes an upper surface operable to support an object thereon. A lip is formed along the rear perimeter edge of the upper surface. The frame member includes an upper portion having an angular perimeter edge. Contiguously formed with the upper portion is an arm that is configured to extend downward therefrom. The arm is inserted into the channel.

Existing French cleats put notable loads on the wall bracket portion that attempt to pull it from the mounting surface if the object is warped away from the wall at center or if, in the case of a canvas covered frame, the canvas is folded in multiple layers at the corners. Moving the bottom of a mounted object away from the wall applies similar forces that can loosen or dislodge the wall bracket if the fasteners cannot withstand substantial loads.

Accordingly, there is a need for a French cleat type hanging apparatus that addresses one or more of the foregoing limitations.

SUMMARY

In one aspect, an apparatus for supporting an object on a wall includes a wall member including a rear side defining a wall mount plane to be held against a wall surface and a recess defined at least in part by a front wall portion that extends upwardly and forwardly from a support ledge, wherein the recess includes an open top section. A frame member includes a frame mount section for engaging a frame, and an arm extending downward from the frame mount section for positioning down into the recess of the wall member such that the frame member will be supported by the wall member. The front wall portion and the arm are configured such that an interaction of the arm and a rear surface of the front wall portion during a downward movement of the arm into the recess while the frame mount section is spaced away from the wall surface will cause at least one of the front wall portion or the arm to flex in order to enable a bottom end of the arm to continue downward toward a seated position.

In another aspect, an apparatus for supporting an object on a wall includes a wall member including a rear side defining a wall mount plane to be held against a wall surface and a recess defined at least in part by a front wall portion that extends upwardly and forwardly, wherein the recess includes an open top section. A frame member includes a frame mount section for engaging a frame, and an arm extending downward from the frame mount section for positioning down into the recess of the wall member such that the frame member will be supported by the wall member. The front wall portion and the arm are configured such that an interaction of the arm and a rear surface of the front wall portion during a downward movement of the arm into the recess while the frame mount section is spaced away from the wall surface will cause at least one of the front wall portion or the arm to move in order to enable a bottom end of the arm to continue downward toward a stop position.

In a further aspect, an apparatus for supporting an object on a wall includes a wall member including a rear side defining a wall mount plane to be held against a wall surface and a recess defined at least in part by a front wall portion that extends upwardly and forwardly, wherein the recess includes an open top section. A frame member includes a frame mount section for engaging a frame, and an arm extending downward from the frame mount section for positioning down into the recess of the wall member such that the frame member will be supported by the wall member. The recess includes end plates that prevent the arm from sliding laterally out of the recess.

The details of one or more embodiments are set forth in the accompanying drawings and the description below. Other features, objects, and advantages will be apparent from the description and drawings, and from the claims.

DETAILED DESCRIPTION

Figure 1:
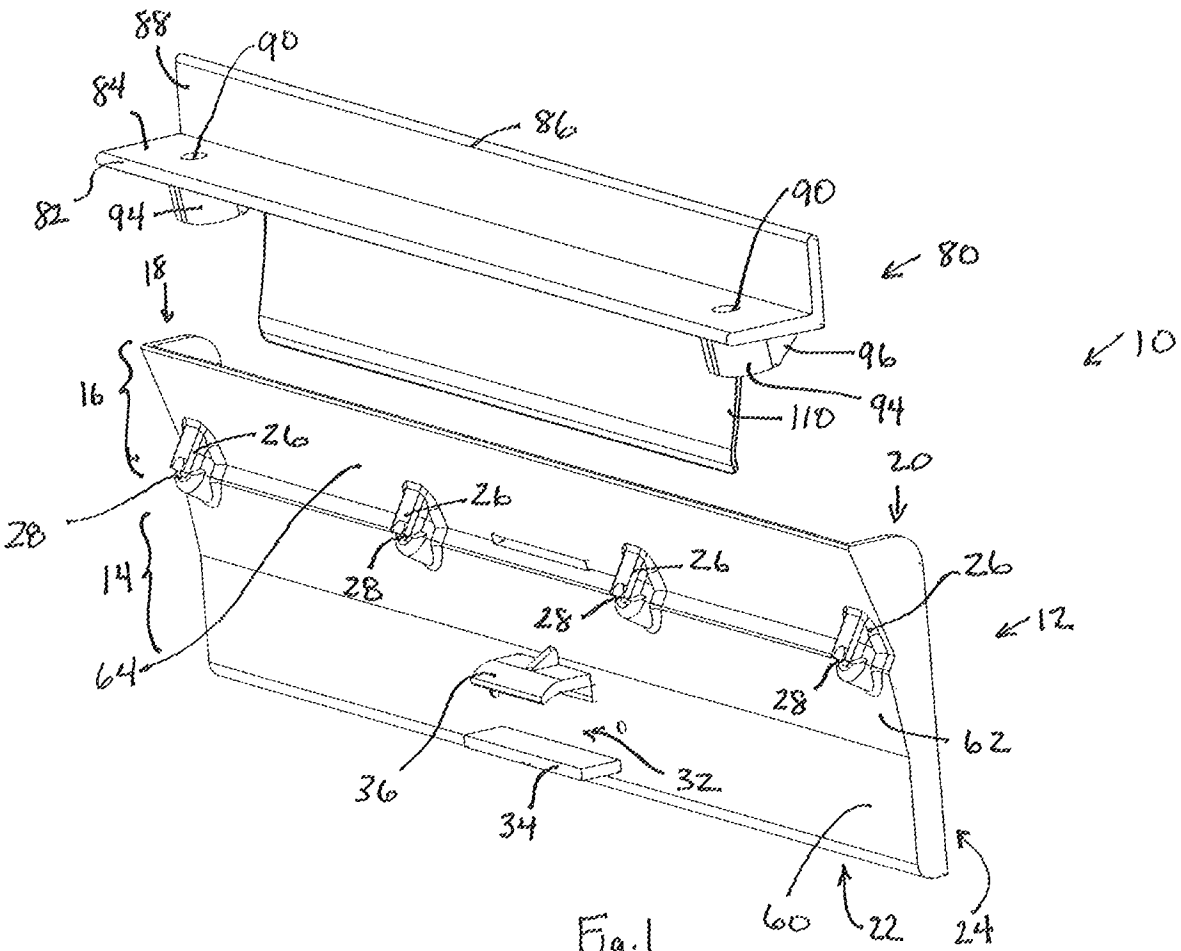
FIG. 1 is a front perspective view of a mount apparatus.
Figure 2:
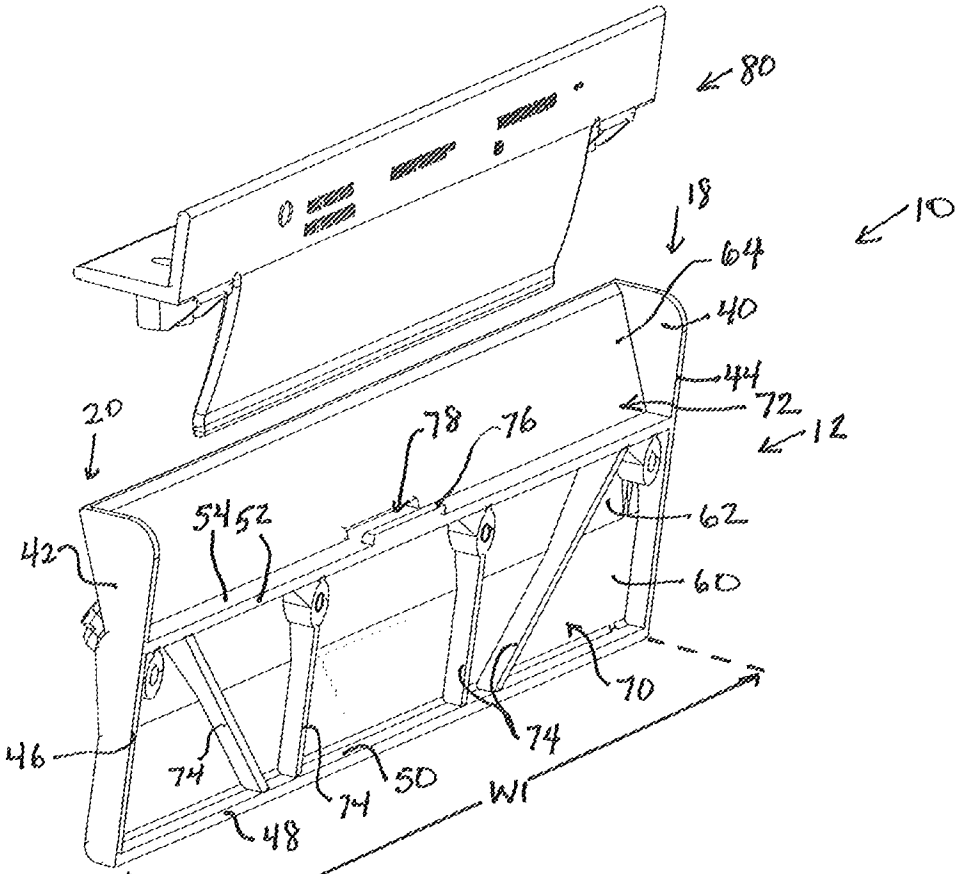
FIG. 2 is a rear perspective view of the apparatus.
Figure 3:
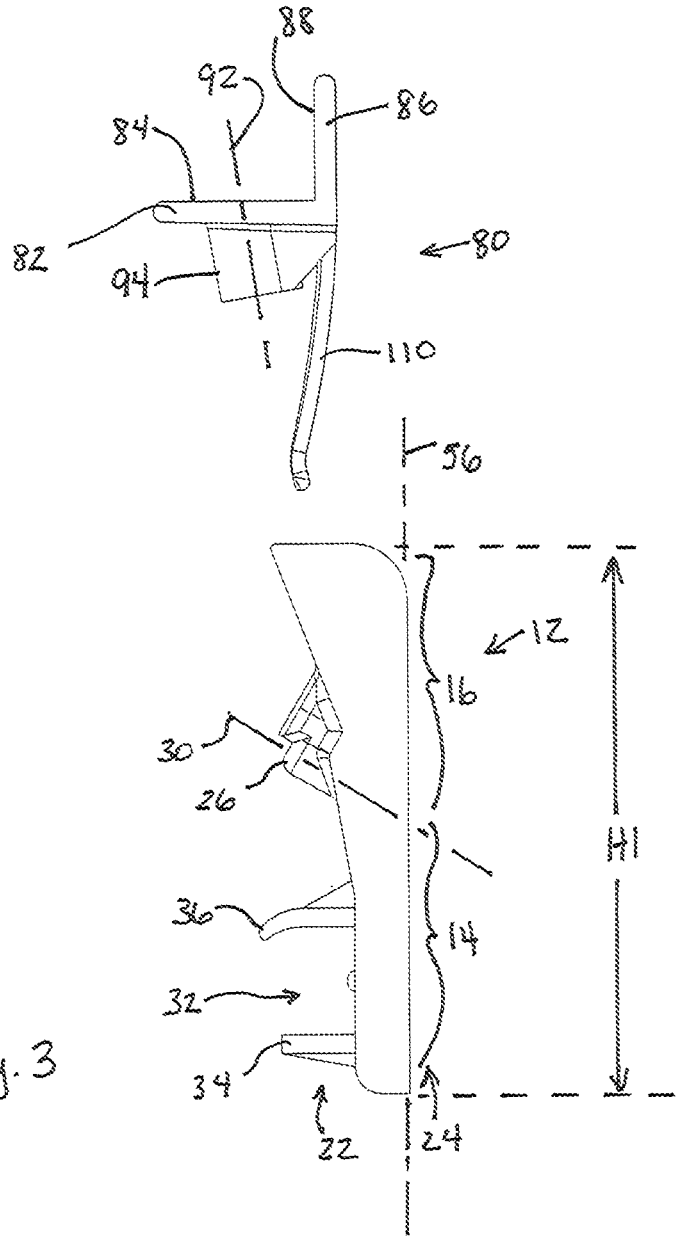
FIG. 3 is a side profile view of the apparatus.
Figure 4:
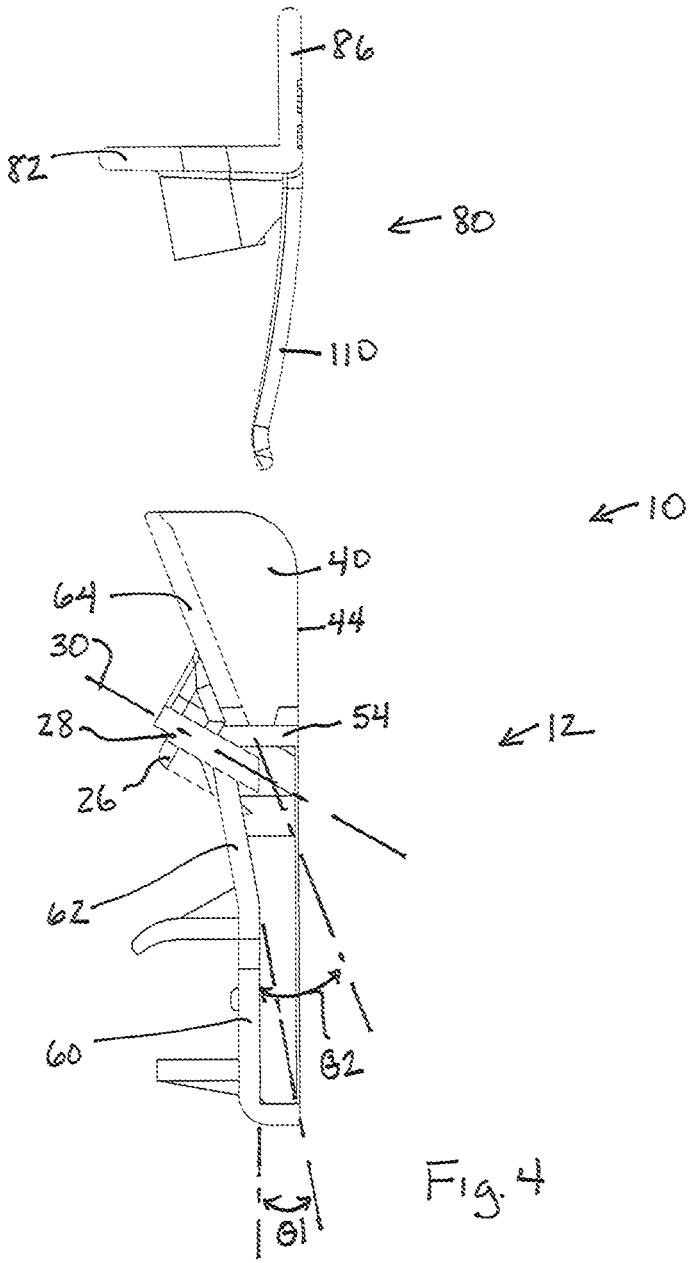
FIG. 4 is a side profile cross-section of the apparatus.

Referring to FIGS. 1-4, a hanging apparatus 10 includes a wall member or bracket 12 configured to be secured to a wall, such as but not limited to the interior surface of a wall within a home, and a frame member or bracket 80. The wall member 12 includes a lower portion 14, an upper portion 16, opposite ends 18, 20, a front side 22 and a back side 24. A plurality of buttress projections 26 protrude at the front side of the wall member, each projection having a through aperture 28 formed therein for receiving a fastener (e.g., a nail or screw) to be used to secure the wall member 12 to the surface of a wall. The apertures extend angularly downward from the front side to the back side of the wall member 12, per aperture axis 30. A capture slot 32 for a bubble level unit is also located on the front side of the wall member, between a lower ledge 34 and an upper cover arm 36.

The opposite ends 18, 20 of the wall member include end plates 40, 42 that have rear edges 44, 46 that are co-planar with each other along most of a height H1 of the wall member 12, and also co-planar with the rear edge 48 of a bottom ledge 50 extending across the width W1 of the wall member 12 and a rear edge 52 of an upper ledge 54 extending across the width W1. The collective rear edges 44, 46, 48 and 52 therefore define or lie in a wall mount plane 56 of the wall member 12.

At the front side of the wall member 12, a lower front wall portion 60 runs substantially vertically (e.g., parallel to the wall mount plane 56), a middle or intermediate front wall portion 62 extends at an angle θ1 (relative to wall portion 60) forward and upward from the lower front wall portion 60 to the upper ledge 54, and an upper front wall portion 64 extends at an angle θ2 (relative to wall portion 60) forward and upward from the upper ledge 54, where angle θ2 is greater than angle θ1. By way of example, angle θ1 may be between 7 and 13 degrees, and angle θ2 may be between 18 and 24 degrees, though other variations are possible. The surfaces may also be curved in some embodiments. Notably, each buttress projection 26 includes a portion on a front surface of the upper front wall portion 64 and a portion on a front surface of the intermediate front wall portion 62.

A rear recess 70 at the back side of the wall member is bounded by the front wall portions 60 and 62, the ledges 50 and 54 and the lower sections of the end plates 40 and 42. Support struts 74 are also provided within the rear recess 70 and run between the ledges 50 and 54. A rear recess 72 at the back side of the wall member is bounded by the front wall portion 64, the upper ledge 54 and the upper sections of the end plates 40 and 42. Unlike recess 70, recess 72 is not bounded at the top, enabling the recess 72 to receive part of the frame member 80. In this regard, a lip 76 extends upwardly from the top surface of the upper ledge 54 and is spaced from the front wall portion 64 to form a lower receiving slot 78 between the two. Thus, the lip 76 and front wall portion 64 may be considered spaced apart upwardly extending legs with an intermediate channel therebetween.

Figure 5:
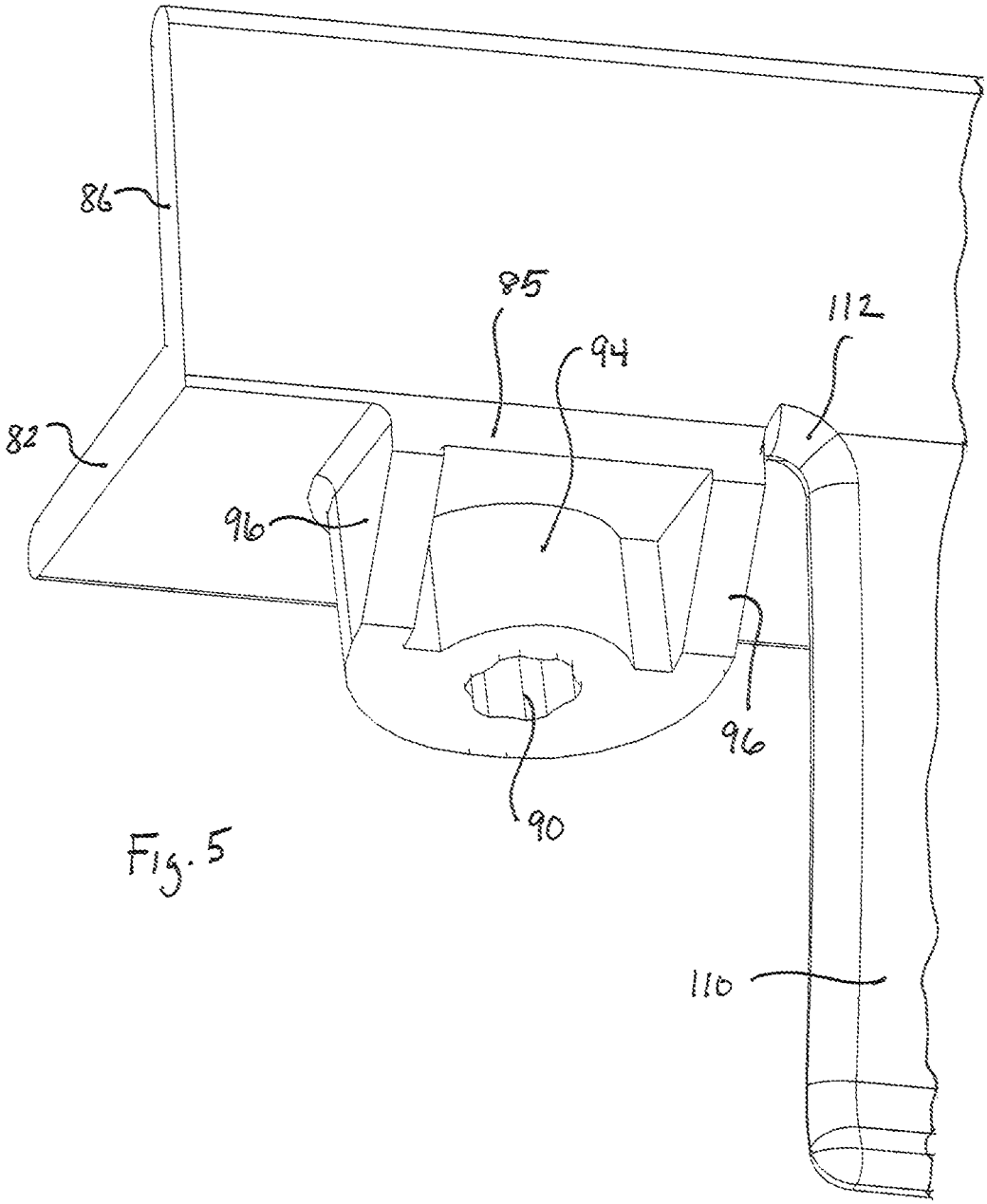
FIG. 5 is partial perspective view of the frame member.

The frame member 80 includes a ledge 82 with a planar upper surface 84 and an upwardly extending lip 86 having a forward facing surface 88. The surfaces 84 and 86 of the ledge 82 and lip 86 form a right angle that is well suited to receiving an object, such as a picture or art frame (e.g., a frame of an open back canvas), for mounting to the object. Thus, the ledge 82 and lip 86 together form a frame mount section of the wall member. The frame member 80 includes fastener apertures 90 for such purpose, with the apertures 90 oriented at an angle with respect to the surface 84, per aperture axis 92. The apertures 90 extend through the ledge 82 and through aperture bosses 94 located at, and projecting down from, the underside of the ledge 82. As best seen in FIG. 5, each aperture boss 94 also include spaced apart structural ribs 96, and a thickened region 85 of the ledge 82, that connect the boss 94 to the rear side of the wall member 80.

In one implementation, both the wall member 12 and the frame member 80 are formed of PVC or other plastics material (e.g., by molding all portions as a monolithic unit) with geometry and material properties that support deflection of the flexible member to provide elastic lateral movement of the end of the arm in relation to the upward wall of the wall bracket by at least 1/16", individually or in combination. Alternative designs employing springs to facilitate elastic flexure of rigid members are also possible, as well as hinged connections without springs. This is different than the typical French cleats of the prior art, which are commonly made of metal (e.g., extruded aluminum) or wood.

Figure 6:
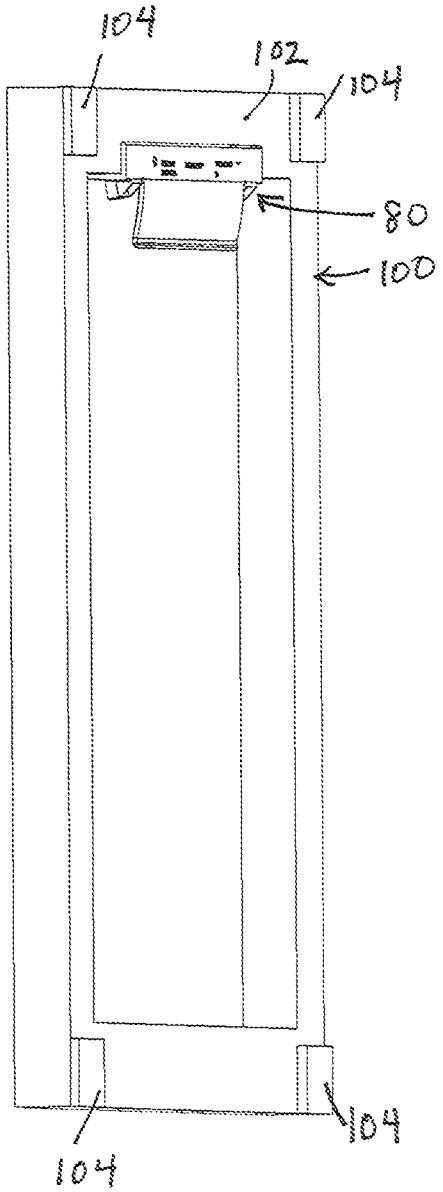
FIGS. 6-7 are rear perspective views of the frame member mounted to an art frame.
Figure 7:
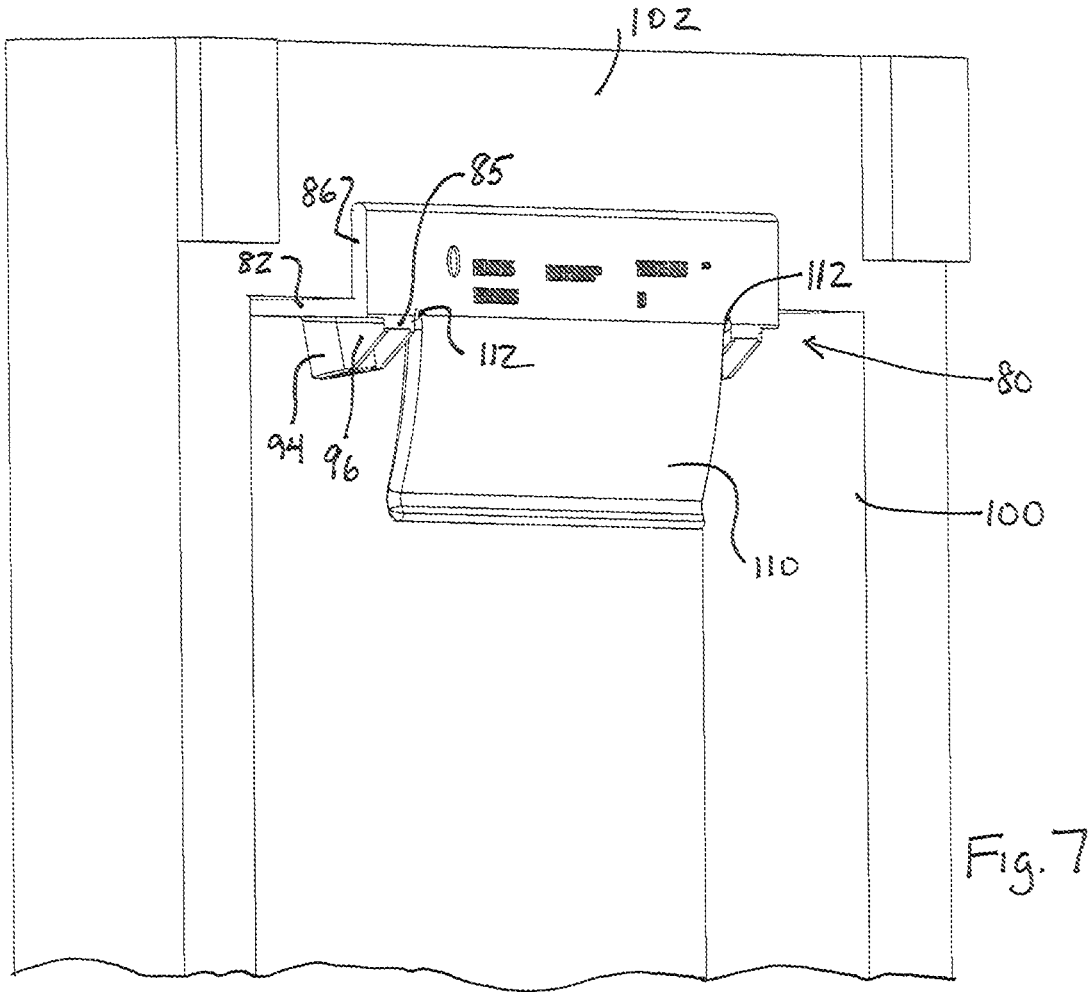
Figure 8:
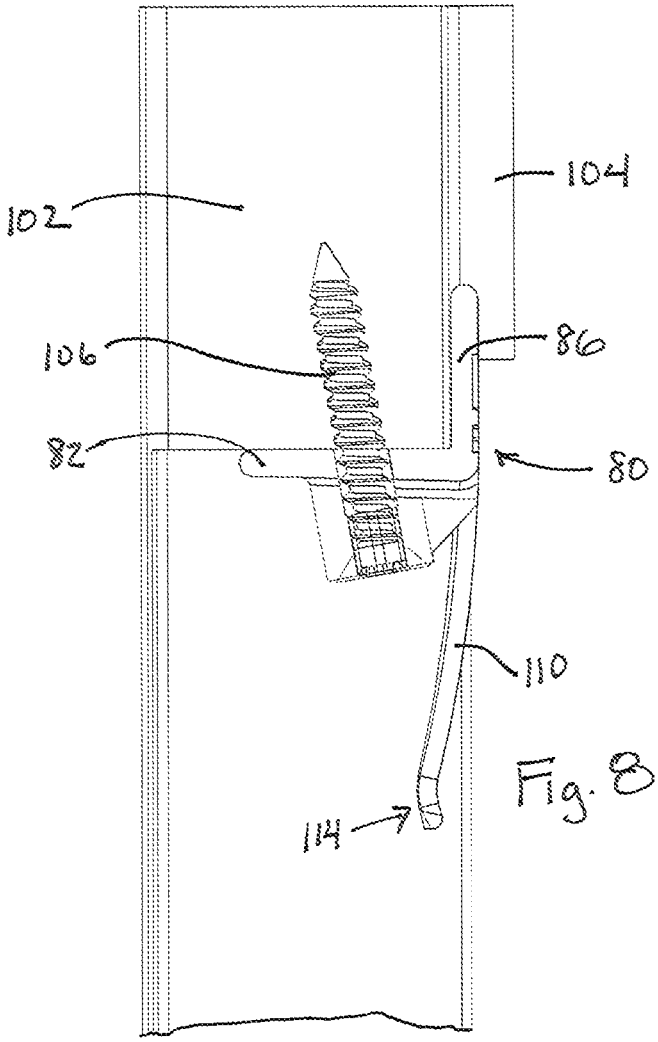
FIG. 8 is a side profile cross-section of the frame member mounted to the art frame.

FIGS. 6-8 show the frame member 80 mounted to the upper leg 102 of a frame 100 of artwork to be mounted using screws 106. Here, a canvas-backed artwork frame is shown, and corner regions 104 in the corners represent overlapping, bunched canvas sections. The frame member 80 includes a downwardly extending arm 110. The arm 110 is configured for placement in the recess 72 of the wall member 12, by lowering the arm 110 down into the open top of the recess 72. Notably, the arm 110 does not extend the full width of the frame member. Instead, the arm 110 is located between the aperture bosses 94. At the upper end of the arm 110, where the arm 110 joins the corner where the ledge 82 and the lip 86 intersect and abut, each side of the arm includes fillets 112 or other curved connections that aid in providing some flexibility in the arm 110. In addition, the arm 110 includes a degree of forward curvature (in side profile), when moving downward, along a majority of the height of the arm 110, and the bottom segment 114 of the arm includes a reverse or rearward curvature (in side profile), when moving downward. These features are also provided to facilitate some flexing of the arm 110 as may be needed in some installations, as further described below.

Figure 9:
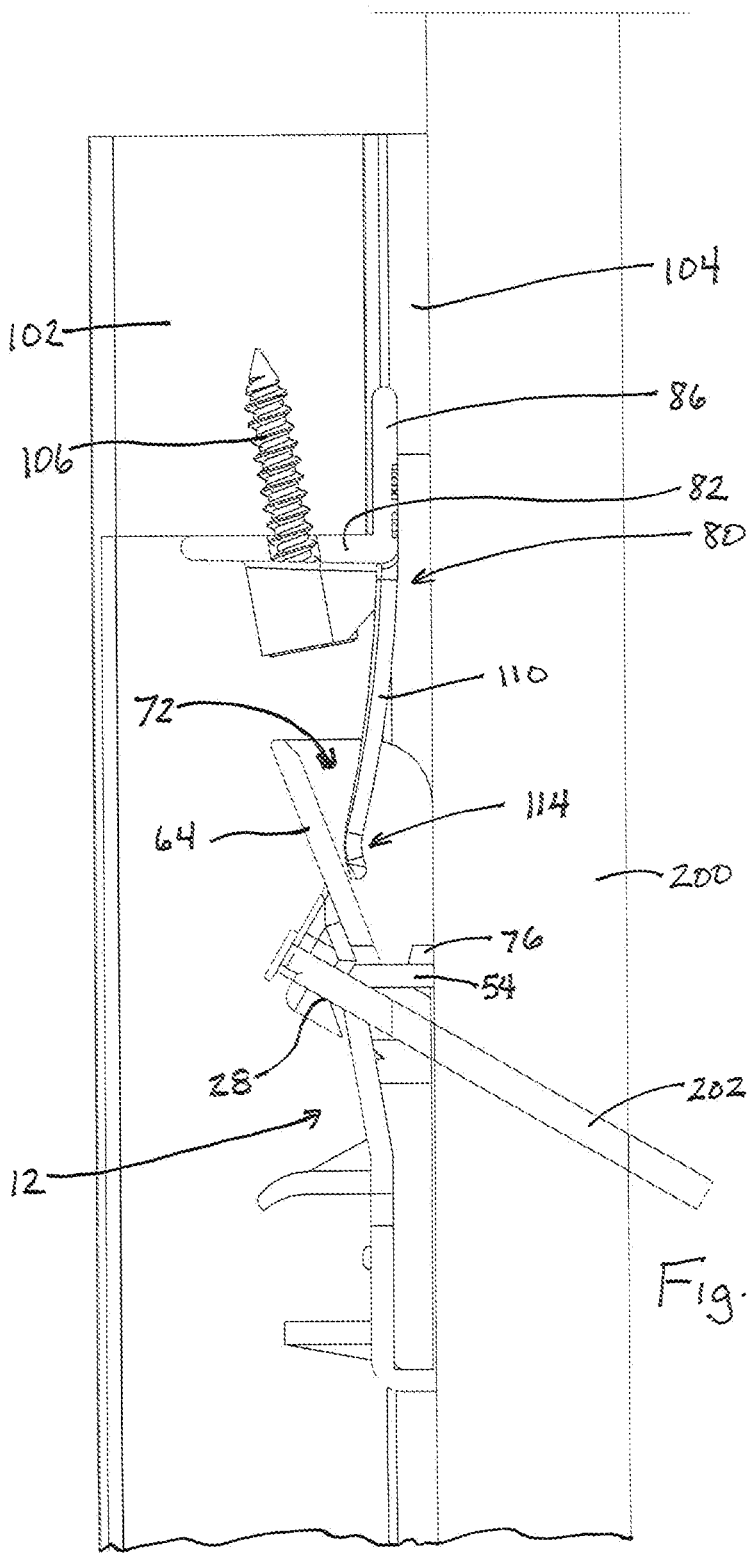
FIG. 9 is a side profile cross-section of the apparatus with wall member mounted to a wall and the frame member moving into engagement with the wall member.
Figure 10:
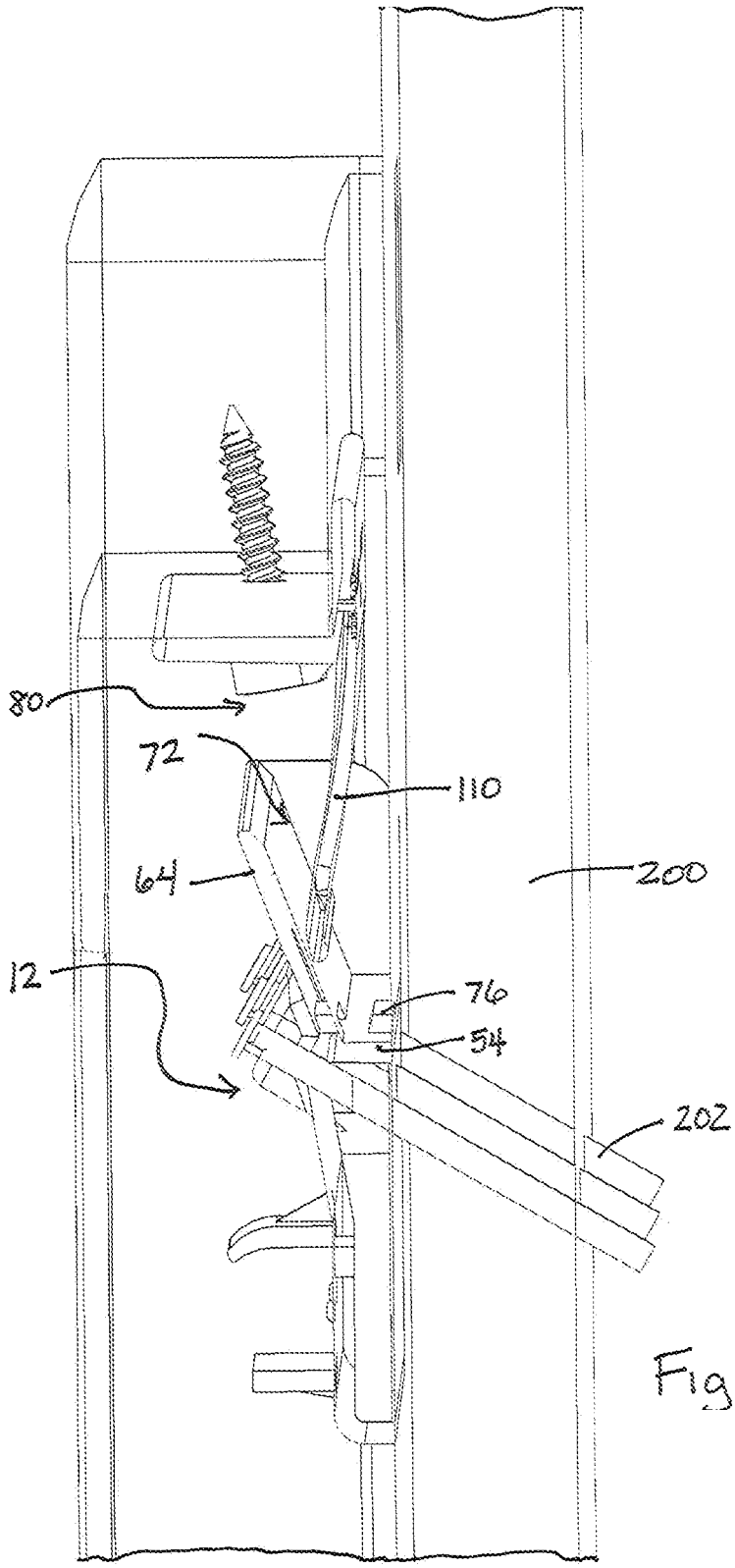
FIG. 10 is a perspective cross-section of the FIG. 9 view.
Figure 11:
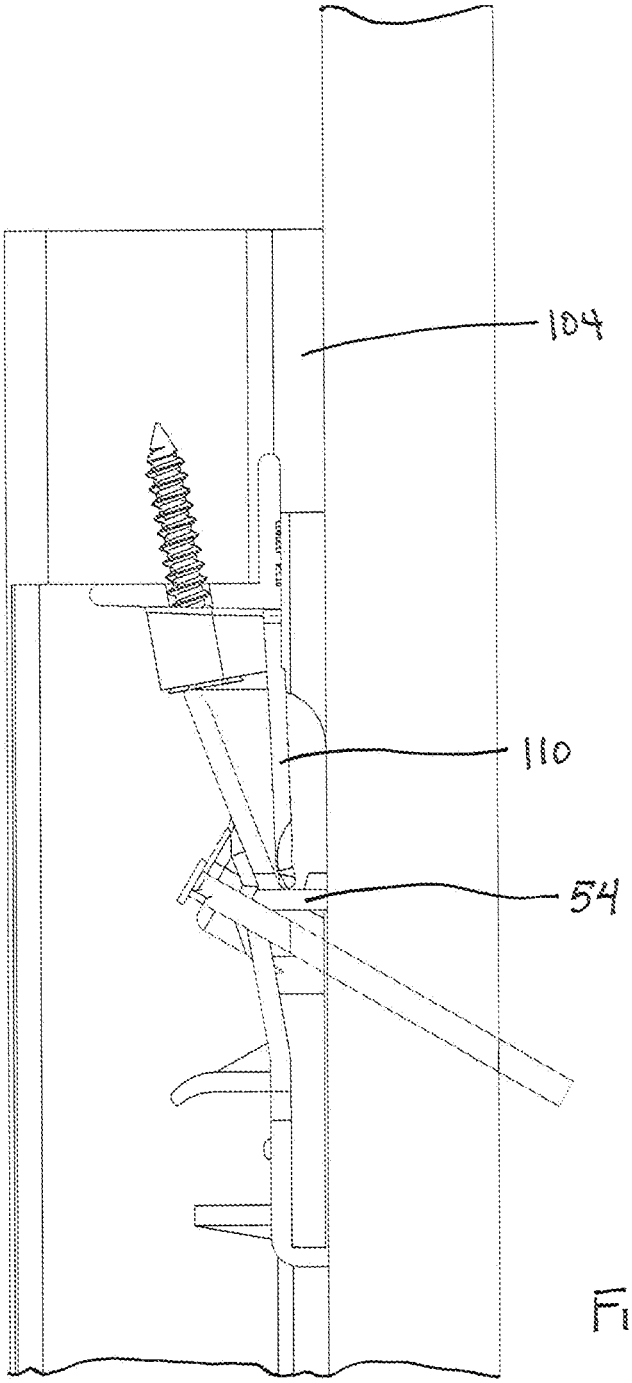
FIG. 11 is a side profile cross-section of the apparatus with wall member mounted to a wall and the frame member moved into fully engaged position with the wall member, with mount arm flexed.

In this regard, reference is made to the cross-sections of FIGS. 9 and 10, which show initial positioning of the frame member 80, with attached art frame, as the arm 110 moves down into the recess 72 of the wall member 12, which is mounted to a wall 200 (e.g., drywall or other wallboard) by a plurality of fasteners 202 through the apertures 28. As shown, the bunched corner regions 104 engage the front surface of the wall 200, holding the frame member 80 slightly away from the wall 200 and causing the bottom segment 114 of the arm 110 to engage with the rear surface of the front wall portion 64 as the arm is moved down into the recess 72. The rearward curvature of the bottom segment 114 of the arm presents a convex surface against the rear surface of the front wall portion 64, which facilitates sliding of the bottom segment 114 downward along the rear surface. As continued downward progression of the arm and the sliding action occurs, forces on the arm cause the arm to flex in order to enable the frame member 80 to be fully seated in the recess 72, with the bottom of the arm 110 resting on the top surface of the ledge 54, per FIG. 11. Here, the flexing of the arm 110 occurs along a substantial majority of the overall height of the arm 110 (e.g., along at least sixty percent of the arm height, such as at least seventy percent of the arm height or at least eighty percent of the arm height). This type of flexing of the arm avoids placing an excessive amount of stress at any single location along the arm height, particularly at the upper end of the arm where the arm joins the ledge 82 and lip 86.

The flexing feature of the described mounting apparatus makes the apparatus better suited to mounting of framed objects in which the frame is either warped away from the wall at center or has bunched corner regions which tend to hold the frame member away from the wall, thereby reducing the likelihood that the forces of the interacting frame member 80 and wall member 12 will tend to pull the wall member away from the wall. When the frame member 80 is subsequently removed from engagement with the wall member 12, the arm 110 will, as a result of material/shape memory, revert back to its normal position, and thus is suited for use multiple times. Notably, the end plates 40 and 42 bound the sides of the recess 72, to prevent the arm 110 from being able to slide laterally out of the recess.

Figure 12:
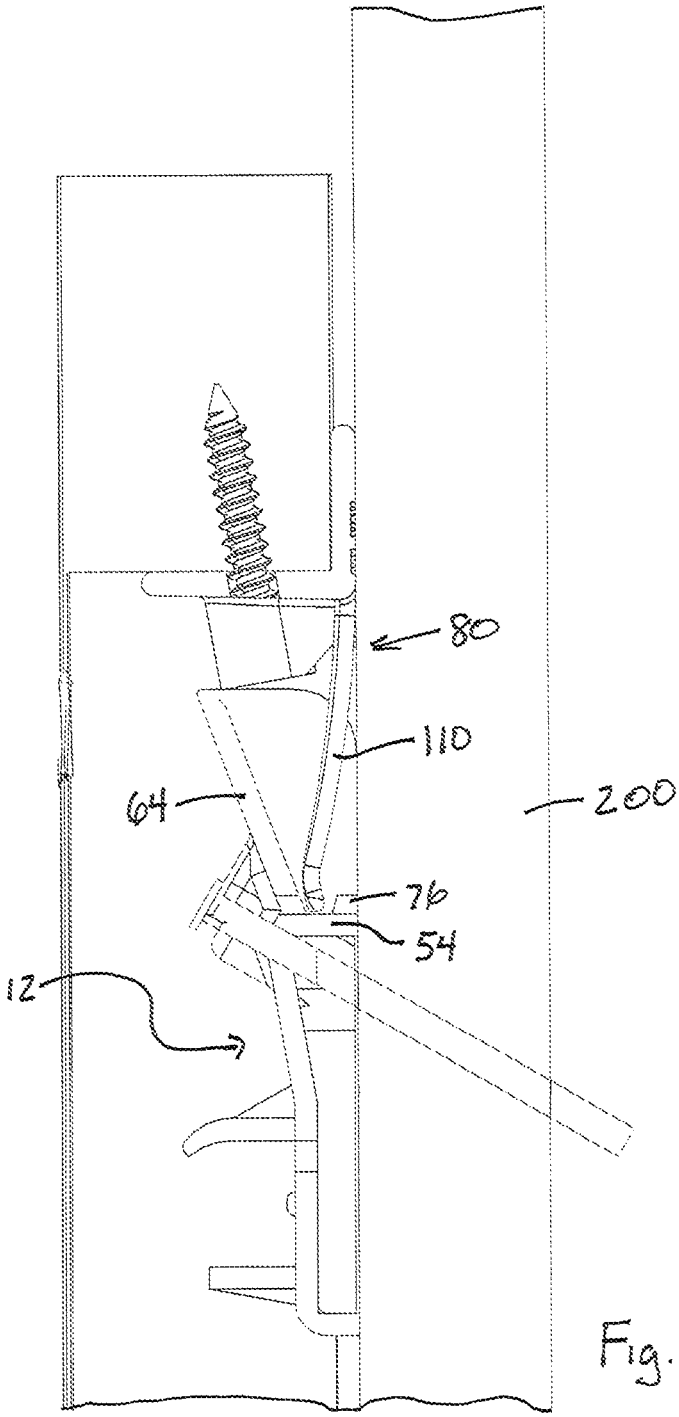
FIG. 12 is a side profile cross-section of the apparatus with wall member mounted to a wall and the frame member moved into fully engaged position with the wall member, with mount arm not flexed.

As noted above, the flexing of the arm occurs in situations where the frame section of the frame member 80 are not able to contact the front surface of the wall 200 (e.g., when the rear side of the lip 86 is held away from the wall surface for some reason, which typically is due to the configuration of the frame or something attached to the frame, such as canvas. In situations in which the rear side of the lip 86 is able to contact the front surface of the wall 200, the arm 100 does not need to flex in order for the bottom end of the arm 110 to reach and be supported by the ledge 54, as reflected in FIG. 12.

It is to be clearly understood that the above description is intended by way of illustration and example only, is not intended to be taken by way of limitation, and that other changes and modifications are possible. For example, while the arm 110 in the illustrated embodiment is shown and described as curved along a majority of its height, the arm could include planar sections or could be majority planar. It is also possible to configure the components such that the upwardly extending front wall portion 64 of the wall member 82 flexes, rather than, or in combination with, the arm 110. It is further possible to configure the components such that some or all flexing is achieved by other portions of either or both the wall member 12 and/or the frame member 80. Moreover, although the fully seated position of the arm in the illustrated embodiment is with the bottom end of the arm atop the ledge 54, in other variations the fully seated position or stop position could place the bottom end of the arm 110 above the ledge 54, such as seating against some other structure of the bracket 12 (e.g., structure at or protruding from the back of the wall portion 64; structure protruding from the ends 18, 20; or structure protruding upward from the ledge). The seated or stop position could also be defined by interaction of the bottom end of the arm 110 with the back surface of wall portion 64 when a flex limit of the arm 110 is reached.

What is claimed is:

1. An apparatus for supporting an object on a wall, comprising:

a wall member including a rear side defining a wall mount plane to be held against a wall surface and a recess defined at least in part by a front wall portion that extends upwardly and forwardly from a support, wherein the recess includes an open top section;

a frame member including a frame mount section for engaging a frame, and an arm extending downward from the frame mount section for positioning down into the recess of the wall member such that the frame member will be supported by the wall member;

wherein the front wall portion and the arm are configured such that an interaction of the arm and a rear surface of the front wall portion during a downward movement of the arm into the recess while the frame mount section is spaced away from the wall surface will cause at least one of the front wall portion or the arm to flex in order to enable a bottom end of the arm to continue downward toward a seated position;

wherein the arm extends downwardly and forwardly away from a wall facing rear surface of the frame mount section, along a majority of a height of the arm, when moving downwardly along the arm from the frame mount section.

2. The apparatus of claim 1, wherein the front wall portion remains fixed as the arm member flexes in order to enable the bottom end of the arm to reach the seated position.

3. The apparatus of claim 2, wherein the support is a support ledge, and wherein, in the seated position, the bottom end of the arm sits atop the support ledge.

4. The apparatus of claim 2, wherein the arm includes a curvature along the majority of the height of the arm.

5. The apparatus of claim 4, wherein the arm includes a forward curvature, along an upper portion of the height of the arm, when extending downward from the frame mount section.

6. The apparatus of claim 5, wherein a bottom section of the arm includes a rearward curvature.

7. The apparatus of claim 6, wherein the rearward curvature of the bottom section presents a convex forward facing surface that facilitates sliding against the rear surface of the front wall portion.

8. The apparatus of claim 1, wherein the arm includes side edges, where a top of the arm joins the frame mount section, the side edges extend upwardly away from the bottom end of the arm and then curve outwardly, forming curved segments, to join the frame mount section.

9. The apparatus of claim 1, wherein the recess includes end plates that prevent the arm from sliding laterally out of the recess.

10. The apparatus of claim 1, wherein the front wall portion is an upper front wall portion of the wall member, and the wall member further includes a lower front wall portion and an intermediate front wall portion, wherein the lower front wall portion runs substantially parallel to the wall mount plane, wherein the intermediate front wall portion extends upwardly and forwardly from the lower front wall portion.

11. The apparatus of claim 1, wherein the arm flexes rearwardly toward the wall mount plane as the bottom end of the arm moves downward toward the seated position.

12. An apparatus for supporting an object on a wall, comprising:

a wall member including a rear side defining a wall mount plane to be held against a wall surface and a recess defined at least in part by a front wall portion that extends upwardly and forwardly from a support, wherein the recess includes an open top section;

a frame member including a frame mount section for engaging a frame, and an arm extending downward from the frame mount section for positioning down into the recess of the wall member such that the frame member will be supported by the wall member;

wherein the front wall portion and the arm are configured such that an interaction of the arm and a rear surface of the front wall portion during a downward movement of the arm into the recess while the frame mount section is spaced away from the wall surface will cause at least one of the front wall portion or the arm to flex in order to enable a bottom end of the arm to continue downward toward a seated position;

wherein the front wall portion is an upper front wall portion of the wall member, and the wall member further includes a lower front wall portion and an intermediate front wall portion, wherein the lower front wall portion runs substantially parallel to the wall mount plane, wherein the intermediate front wall portion extends upwardly and forwardly from the lower front wall portion;

wherein the upper front wall portion is offset from the wall mount plane by a first angle, the intermediate front wall portion is offset from the wall mount plane by a second angle, and the first angle is greater than the second angle;

a plurality of aperture projections located along a front side of the wall member, each aperture projection including a mount aperture therethrough;

wherein each aperture projection is formed as a buttress projection that includes a portion on a front surface of the upper front wall portion and a portion on a front surface of the intermediate front wall portion.

13. An apparatus for supporting an object on a wall, comprising:

a wall member including a rear side defining a wall mount plane to be held against a wall surface and a recess defined at least in part by a front wall portion that extends upwardly and forwardly, wherein the recess includes an open top section;

a frame member including a frame mount section for engaging a frame, and an arm extending downward from the frame mount section for positioning down into the recess of the wall member such that the frame member will be supported by the wall member;

wherein the front wall portion and the arm are configured such that an interaction of the arm and a rear surface of the front wall portion during a downward movement of the arm into the recess while the frame mount section is spaced away from the wall surface will cause at least one of the front wall portion or the arm to move in order to enable a bottom end of the arm to continue downward toward a stop position;

wherein the front wall portion extends forwardly, away from the rear wall mount plane, when moving upward along the front wall portion;

wherein the arm extends forwardly, away from the wall mount plane, when moving downwardly along the arm, as the arm moves into the recess.

14. The apparatus of claim 13, wherein the arm flexes in order to enable the bottom end of the arm to continue downward toward the stop position.

15. The apparatus of claim 13, wherein a material of the arm bends to achieve flex of the arm.

16. The apparatus of claim 13, wherein at least one spring member is provided to allow the arm to move relative to the front wall portion.

17. An apparatus for supporting an object on a wall, comprising:

a wall member including a rear side defining a wall mount plane to be held against a wall surface and a recess defined at least in part by a front wall portion that extends upwardly and forwardly, wherein the recess includes an open top section;

a frame member including a frame mount section for engaging a frame, and an arm extending downward from the frame mount section for positioning down into the recess of the wall member such that the frame member will be supported by the wall member;

wherein the recess includes end plates that prevent the arm from sliding laterally along a width of the wall member and out of the recess.

* * * * *